US006079410A

United States Patent [19]

Winefordner et al.

[11] Patent Number: 6,079,410

[45] Date of Patent: Jun. 27, 2000

[54] COLLAPSIBLE SNORKEL

[75] Inventors: Carl Winefordner; Frank Hermansen, both of Corona Del Mar, Calif.

[73] Assignee: Q.D.S. Injection Molding, Inc., San Diego, Calif.

[21] Appl. No.: 09/110,293

[22] Filed: Jul. 6, 1998

[51] Int. Cl.[7] ..... B63C 11/16

[52] U.S. Cl. ..... 128/201.11; 128/201.27; 128/201.28

[58] Field of Search ..... 128/201.11, 201.27, 128/201.28

[56] References Cited

U.S. PATENT DOCUMENTS

| | | | |
|---|---|---|---|
| 3,993,060 | 11/1976 | Mitchell | 128/201.11 |
| 4,071,024 | 1/1978 | Blanc | 128/201.11 |
| 4,860,739 | 8/1989 | Vandepol | 128/201.11 |
| 5,117,817 | 6/1992 | Lin | 128/201.11 |
| 5,143,059 | 9/1992 | Delphia | 128/201.11 |
| 5,199,422 | 4/1993 | Rasocha | 128/201.11 |
| 5,239,990 | 8/1993 | Delphia | 128/201.11 |
| 5,265,591 | 11/1993 | Ferguson | 128/201.11 |
| 5,280,785 | 1/1994 | Fujima | 128/201.11 |
| 5,529,057 | 6/1996 | Ferrero et al. | 128/201.11 |
| 5,845,635 | 12/1998 | Hermansen et al. | 128/201.11 |
| 5,865,169 | 2/1999 | Lan et al. | 128/201.11 |
| 5,906,199 | 5/1999 | Budzinski | 128/201.11 |
| 5,960,791 | 10/1999 | Winefordner et al. | 128/201.11 |

*Primary Examiner*—John G. Weiss
*Assistant Examiner*—Joseph F. Weiss
*Attorney, Agent, or Firm*—Leonard Tachner

[57] ABSTRACT

A snorkel device having a body, a folding upper tube and a collapsible, corrugated lower tube, permits reduction in length to about one-third of the deployed length for storage in a buoyancy jacket or the like. The corrugated tube permits virtually unlimited orientation of the mouthpiece for maximum comfort and function.

2 Claims, 5 Drawing Sheets

COLLAPSIBLE SNORKEL

BACKGROUND OF THE INVENTION

1. Field of the Invention

The invention relates generally to snorkeling apparatus and more specifically to a snorkel tube device that collapses for convenient storage.

2. Prior Art

Snorkels are typically of similar size. Their cross section is fairly standard because they must have a large enough air opening for a person to breath with relative ease. Their length is fairly standard because they must extend from the user's mouth to above their head (and consequently above the water line). Snorkels are typically made in two varieties:

1. With a flex elbow primarily used by SCUBA divers. SCUBA divers are generally required to have a snorkel with them for surface swimming in case their air supply runs low. The flex section in a snorkel forces the snorkel out of the way so that it does not interfere with their regulator.

2. With a fixed bent elbow section primarily used by snorkelers. Snorkelers do not need to worry about their snorkel interfering with a regulator. Generally, a fixed bent elbow section makes for a more comfortable snorkel because it does not constantly pull the mouthpiece away from the user's mouth. Fixed bent elbow snorkels cause less jaw fatigue than typical flex elbow snorkels.

SCUBA divers rarely use their snorkel and are often bothered by the snorkel hanging from their mask strap during a dive. Often times during a dive, the snorkel moves and twists due to swimming actions and current. This snorkel movement can be uncomfortable as it twists and pulls the mask strap and hair. Also, for underwater photography, the snorkel can interfere with both the one taking the picture and with the one who's picture is being taken. Moreover, the snorkel can detract from the picture itself if the snorkel is in an awkward position. Many SCUBA divers would prefer to store their snorkel in a pocket of their buoyancy compensator but the snorkel is generally too large.

Many snorkelers and SCUBA divers travel frequently. Many prefer to bring their own equipment but the bulk of the equipment, including their snorkel, is a problem.

There is a general trend to make diving and snorkeling equipment smaller and lighter in order to make traveling easier, diving and snorkeling more pleasurable and for aesthetics. Available on the market today are smaller regulators, masks, buoyancy compensators, gauges and air cylinders.

As previously discussed, snorkels with flex elbows are often used by SCUBA divers but they can cause jaw fatigue due to the flex material's memory which constantly pulls the mouthpiece away from the user's mouth. When the diver is not using the snorkel, the flex section permits the mouthpiece portion of the snorkel to hang somewhat away from the mouth region. Because the snorkel is attached to the mask strap, the snorkel can easily pivot and move which can cause the mouthpiece portion of the snorkel to bump the regulator and the diver's face.

It would be desirable to have a snorkel that could collapse to a significantly smaller size so that it:

a) Could be easily stored out of the way in a buoyancy compensator pocket;

b) would take up less room while traveling;

c) would allow for more pleasing SCUBA photographs; and d) generally make diving more pleasurable.

Additionally, it would be desirable if this snorkel had a flex elbow that was adjustable without pulling and causing jaw fatigue.

It would also be desirable to have a typical snorkel but with a flex elbow that was adjustable without pulling and causing jaw fatigue and that would allow the user to push the mouthpiece portion farther from the mouth region than traditional flex elbows allow.

SUMMARY OF THE INVENTION

The present invention comprises a collapsible snorkel apparatus having three principal components. One such component is a substantially hollow, rigid body. There is also a folding tube and a corrugated tube. The folding tube is connected to one end of the body for articulation relative thereto. When the snorkel is in its fully collapsed configuration, the folding tube is rotated about the body and is oriented at its base substantially parallel to the body. When the snorkel is in its deployed configuration, the folding tube is oriented in series with the body so that the body and folding tube are in fluid communication. The corrugated tube is affixed at one end to the body and extends through the body exiting at the other end of the body. The other end of the corrugated tube is affixed to a conventional mouthpiece. The corrugated tube is fully compressed into the body when the snorkel is in its fully collapsed configuration. When the snorkel is in its deployed configuration, the corrugated tube is fully extended and then curved near the extended mouthpiece end to form a conventional snorkel/mouthpiece configuration.

OBJECTS OF THE INVENTION

It is therefore a principal object of the present invention to provide a collapsible snorkel which is of relatively standard configuration when deployed for operation, but which may be readily collapsed to a relatively small size which can be stored in the pocket of a buoyancy compensator.

It is another object of the invention to provide a collapsible snorkel which can be collapsed to less than about one-third of its operational length for being stored.

It is still another object of the invention to provide a snorkel in which the mouthpiece is connected to a corrugated tube to permit virtually any desired orientation of the mouthpiece.

It is yet another object of the invention to provide a snorkel having a relatively unobstructed air intake and water exhaust aperture at the end of a folding tube.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
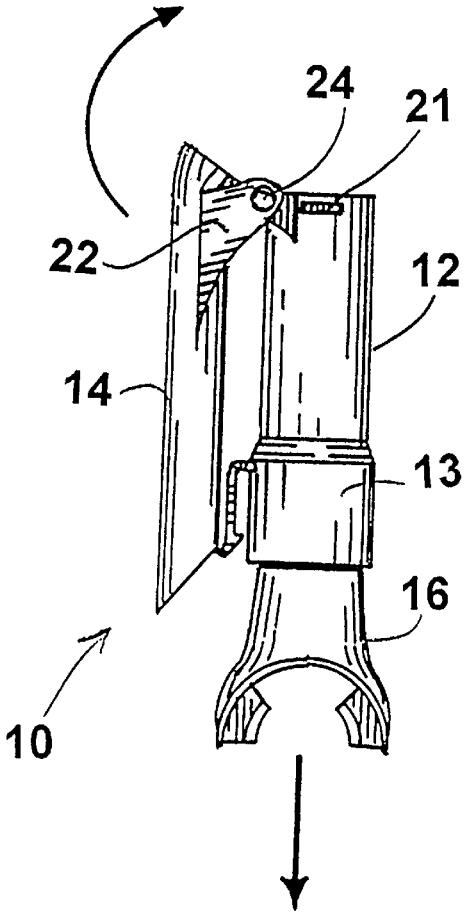
FIG. 1 is an elevational view of the preferred embodiment of the invention shown in its fully collapsed configuration but the mouthpiece lowered slightly.

Referring to the accompanying drawings it will be seen that a collapsible snorkel 10 comprises a body 12, a folding tube 14 and a corrugated tube 18. Body 12 comprises a bell-shaped portion 13 at its lower end to receive a mouthpiece 16. Corrugated tube 18 is connected to the mouthpiece 16 at its lower end. The upper end of body 12 is fitted with a retainer 20 seen best in FIG. 3. Retainer 20 comprises a ring 17, a pair of tabs 19 and a stub 33. Retainer 20 fits into the upper end of body 12 until tabs 19 mate with slots 21. Ring 17 then extends up from body 12 to receive folding tube 14 as shown best in FIG. 4.

Figure 5:
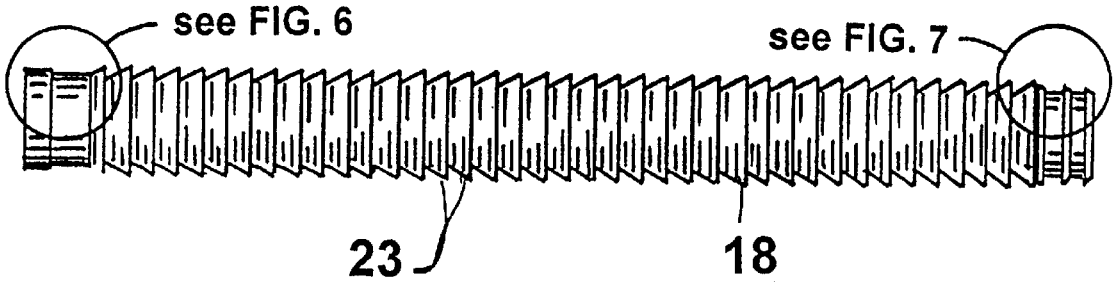
FIG. 5 is a plan view of the corrugated tube of the invention.
Figure 6:
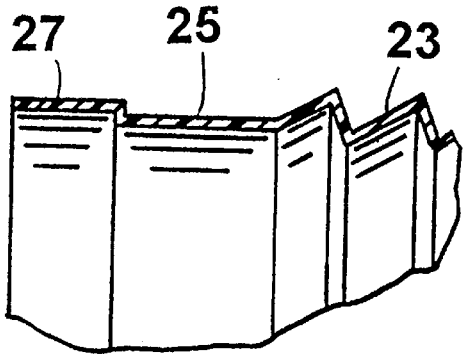
FIG. 6 is an enlarged view of the body end of the corrugated tube.
Figure 7:
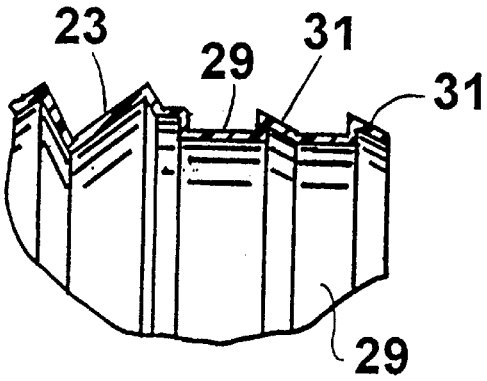
FIG. 7 is an enlarged view of the mouthpiece end of the corrugated tube.

Folding tube 14 comprises a pair of flanges 22 each having a hole 24. Body 12 has a hinge 26 designed to receive the flanges 22 and extend through holes 24 for articulation of the folding tube relative to the body. The body end of corrugated tube 18 as seen best in FIGS. 5 and 6, comprise cylindrical sections 25 and 27 with section 25 having a reduced diameter compared to section 27. Section 27 is sized to engage stub 33 of retainer 20 and to be secured thereto by press fit engagement preferably enhanced by an adhesive such as an epoxy or the like. Engagement can also be accomplished by mechanical interlock such as by shoulders or the like. The opposite end of tube 18 comprises a pair of cylindrical sections 29 in series, each terminating in a short conical section 31. This end of tube 18 is sized to engage the interior of mouthpiece 16 for retention of the mouthpiece onto the end of tube 18. As seen best in FIG. 5, tube 18 comprises an elongated array of corrugations 23 between the body end and the mouthpiece end. The actual number of corrugations is a matter of design choice. Corrugations 23 permit the tube to be selectively collapsed and elongated. Moreover, corrugations 23 permit the tube 18 to be curved at 180 degrees (as shown in FIG. 2*a*) which is especially advantageous at the mouthpiece end. When so curved, the tube 18 retains its selected shape without resistance or any tendency to spring back to a straight configuration. Thus, the mouthpiece may be positioned into virtually any location comfortable to the user by virtue of the characteristics of corrugated tube 18.

Figure 2:
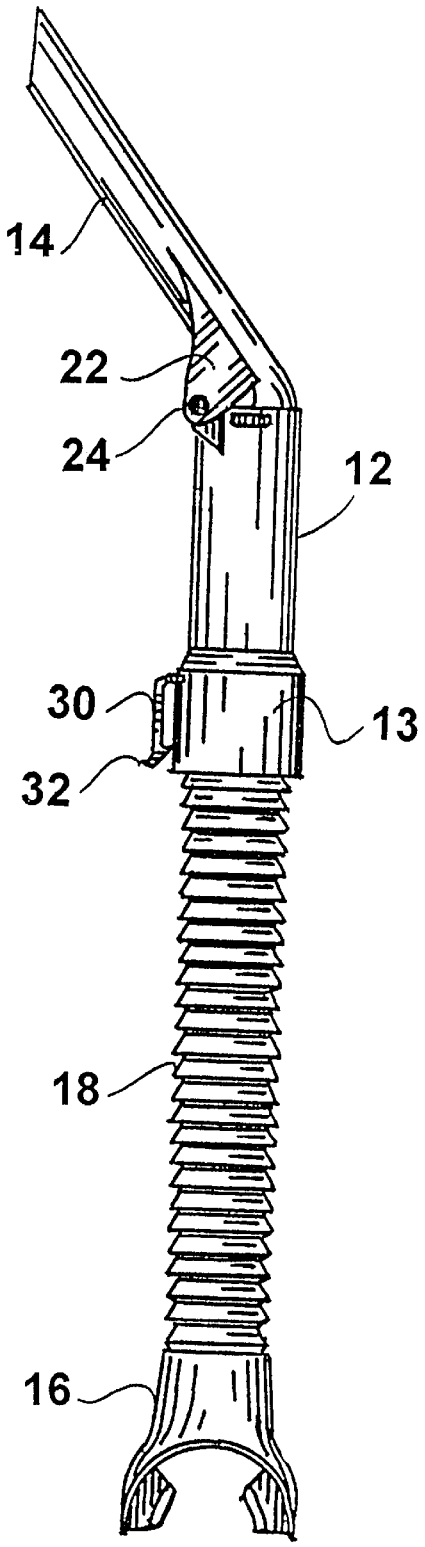
FIG. 2 is an elevational view of the preferred embodiment shown in its fully deployed configuration.
Figure 2A:
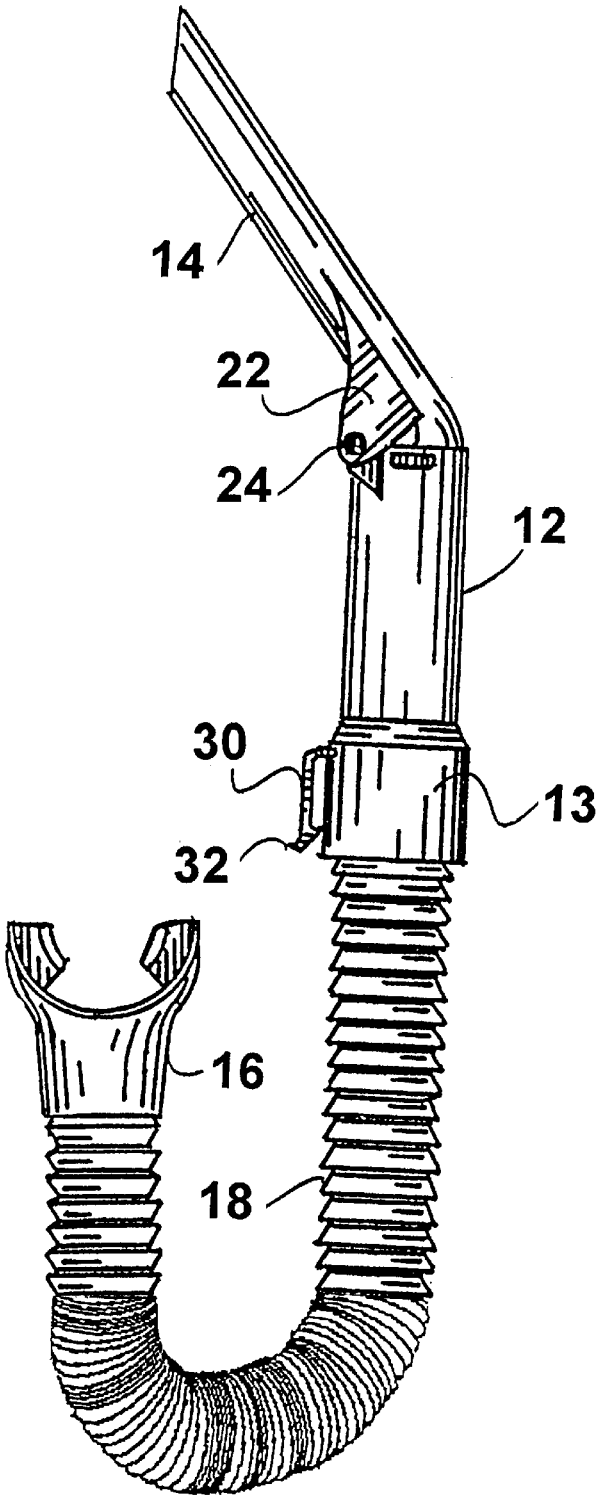
FIG. 2*a* is a view similar to FIG. 2 but with the mouthpiece rotated into its normal functional position.
Figure 3:
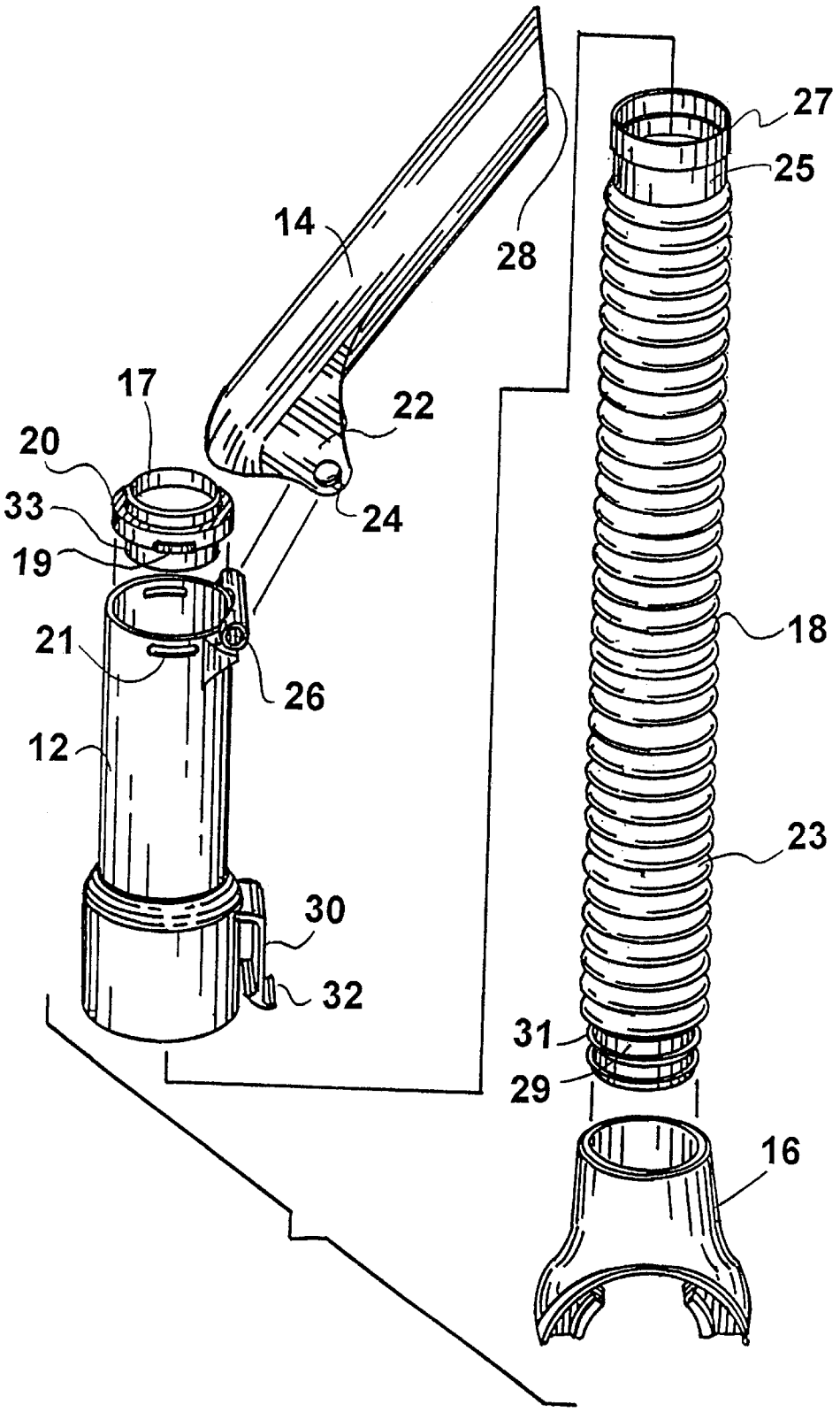
FIG. 3 is an exploded view of the preferred embodiment.
Figure 4:
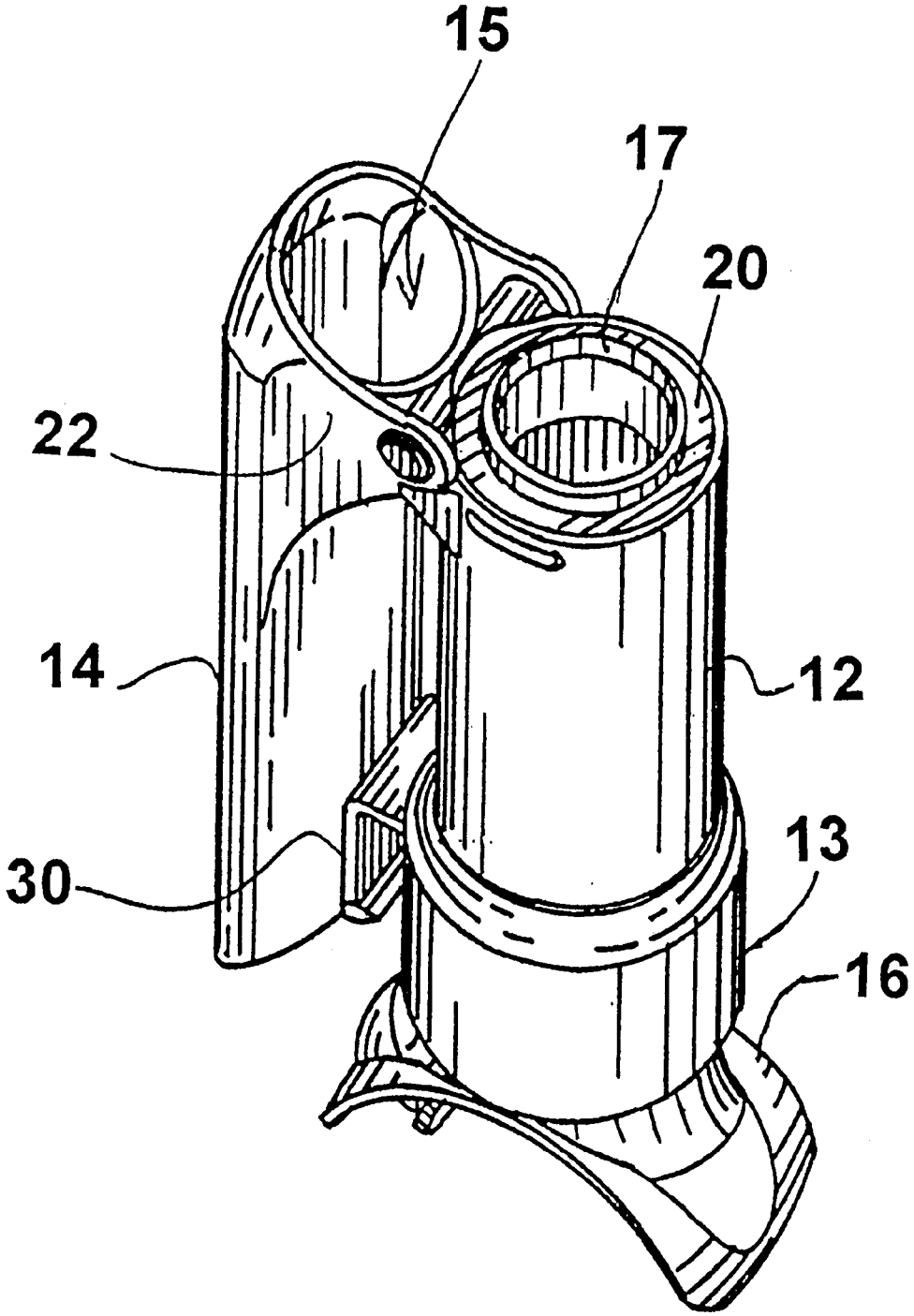
FIG. 4 is an isometric view of the collapsed snorkel illustrating the interface between the folding tube and body thereof.

As shown best in FIGS. 1, 2 and 3, the body 12 has a mask clip 30, the lower end of which is curved outwardly to form a tube hook 32. Folding tube 14 has a channel 15 which terminates in an exterior lip 28. When the folding tube is rotated to its fully folded position as seen in FIG. 1, tube hook 32 engages lip 28 of tube 14 to secure the folded tube in the position shown. When it is desired to extend tube 14 in the deployed position of FIG. 2, one merely rotates the tube after pulling lip 28 away from the grasp of hook 32. When tube 14 reaches the position shown in FIG. 2, it is secured within the top of body 12 by frictional engagement with ring 17 of retainer 20.

Thus, by collapsing corrugated tube 18 and folding tube 14 about hinge 26, the snorkel 10 may be reduced in length to no more than about the length of body 12 which is less than one-third of the fully deployed length of snorkel 10. When the corrugated tube 18 is extended and folding tube 14 is rotated into its connection to retainer 20 within body 12, the snorkel is in its fully deployed configuration. At this point, the snorkeler or diver may wish to curve the mouthpiece end of tube 18 about 180 degrees to suit his or her needs in regard to positioning the mouthpiece for optimum comfort and function. Corrugated tube 18 is preferably fabricated by a blow-molding process well-known in the art.

Having thus disclosed an exemplary illustration of a preferred embodiment, it being understood that the accompanying disclosure is not necessarily limiting of the scope of protection hereof, what is claimed is:

1. A snorkel apparatus comprising:

a tubular body of rigid material having two opposed open ends and having a hinge at one end;

a folding tube connected to said hinge for selective rotation relative to said tubular body between about 0 degrees and about 180 degrees;

a corrugated collapsible tube connected to said tubular body and extending therefrom at an end opposite said hinge; and a mouthpiece connected to said corrugated tube.

2. The snorkel apparatus recited in claim 1 and further comprising a retainer secured within said tubular body for retaining said corrugated tube and having a ring for receiving said folding tube in press-fit engagement in said 0 degrees rotated position.

* * * * *